US011276522B2

(12) United States Patent
Chida et al.

(10) Patent No.: US 11,276,522 B2
(45) Date of Patent: Mar. 15, 2022

(54) COIL COMPONENT AND COIL INSULATING MEMBER

(71) Applicant: Yazaki Corporation, Tokyo (JP)

(72) Inventors: Chiaki Chida, Shizuoka (JP); Akinori Maruyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 439 days.

(21) Appl. No.: 16/413,864

(22) Filed: May 16, 2019

(65) Prior Publication Data

US 2019/0272949 A1 Sep. 5, 2019

Related U.S. Application Data

(63) Continuation of application No. PCT/JP2017/037027, filed on Oct. 12, 2017.

(30) Foreign Application Priority Data

Dec. 21, 2016 (JP) ..... JP2016-247604

(51) Int. Cl.
*H01F 27/32* (2006.01)
*H01F 27/29* (2006.01)
(Continued)

(52) U.S. Cl.
CPC ..... *H01F 27/325* (2013.01); *H01F 27/2847* (2013.01); *H01F 27/29* (2013.01); *H01F 27/306* (2013.01); *H01F 27/324* (2013.01)

(58) Field of Classification Search
CPC .. H01F 27/325; H01F 27/2847; H01F 27/324; H01F 27/306; H01F 27/29; H01F 5/02; H01F 27/32
See application file for complete search history.

(56) References Cited

U.S. PATENT DOCUMENTS 5,748,064 A * 5/1998 Smeenge ..... H01F 27/306 29/605
7,924,133 B2 * 4/2011 Kaneko ..... H01F 27/325 336/200

(Continued)

FOREIGN PATENT DOCUMENTS

JP 2014-165279 A 9/2014

OTHER PUBLICATIONS

International Search Report for PCT/JP2017/037027 dated Dec. 12, 2017 (PCT/ISA/210).

*Primary Examiner* — Mang Tin Bik Lian
(74) *Attorney, Agent, or Firm* — Sughrue Mion, PLLC

(57) ABSTRACT

A coil component and an insulating bobbin are provided with a first insulating bobbin having a first flange portion, a first rib, and a pair of locking claw portions and a second insulating bobbin having a second flange portion, a second rib, and a pair of locking opening portions. The pair of locking claw portions and the pair of locking opening portions are locked in a state where both end portions of a coil winding portion in a coil axis direction are covered with the first and second flange portions and and the first and second ribs and are respectively fitted into first and second slits and of the coil winding portion. As a result, adequate insulation performance can be ensured and workability can be improved when a coil insulating member is assembled to the coil winding portion.

5 Claims, 3 Drawing Sheets

(51) Int. Cl.
*H01F 27/28* (2006.01)
*H01F 27/30* (2006.01)

(56) References Cited

U.S. PATENT DOCUMENTS 9,472,335 B2 * 10/2016 Sun ..... H01F 27/2866
9,728,328 B2 * 8/2017 Lee ..... H01F 30/06
2007/0171023 A1 * 7/2007 Ikezawa ..... H01F 27/325
336/208
2008/0284551 A1 * 11/2008 Chen ..... H01F 27/2866
336/182
2011/0115598 A1 * 5/2011 Wu ..... H01F 27/325
336/212
2012/0154095 A1 * 6/2012 Li ..... H01F 27/06
336/199
2012/0257419 A1 * 10/2012 Kaneko ..... H01F 27/325
363/15
2014/0077916 A1 * 3/2014 Eom ..... H01F 27/306
336/198
2014/0240070 A1 8/2014 Ikezawa
2014/0327511 A1 * 11/2014 Tsai ..... H01F 27/28
336/220

* cited by examiner

COIL COMPONENT AND COIL INSULATING MEMBER

CROSS-REFERENCE TO RELATED APPLICATION

This application is a continuation application of International Application PCT/JP2017/037027, filed on Oct. 12, 2017 which claims the benefit of priority from Japanese Patent application No. 2016-247604 filed on Dec. 21, 2016 and designating the U.S., the entire contents of which are incorporated herein by reference.

BACKGROUND OF THE INVENTION

1. Field of the Invention

The present invention relates to a coil component and a coil insulating member.

2. Description of the Related Art

In the related art, a coil component is used in, for example, a transformer of a switching power supply device or the like. This coil component is provided with a coil winding portion and a bobbin insulating the coil winding portion from other electronic components and the like. In the coil component, the bobbin is assembled to the coil winding portion and covers the upper and lower surfaces of the coil winding portion in a coil axis direction. The coil winding portion is insulated as a result (see, for example, Japanese Patent Application Laid-open No. 2014-165279).

In some cases, the coil winding portion of the coil component is pinched from the coil axis direction by first and second bobbins and the coil winding portion is insulated from both sides in the coil axis direction so that adequate insulation performance is ensured. In this case, workability needs to be improved during the assembly of the first and second bobbins to the coil winding portion. There is room for further improvement in this regard.

SUMMARY OF THE INVENTION

The present invention has been made in view of the above, and an object of the present invention is to provide a coil component and a coil insulating member allowing workability to be improved when the coil insulating member is assembled to a coil winding portion while ensuring adequate insulation performance.

In order to solve the above mentioned problem and achieve the object, a coil component according to one aspect of the present invention includes a coil winding portion formed by a single conductor being wound more than once around a coil axis, a first slit being formed in one end portion of the coil winding portion in a coil axis direction along the coil axis and a second slit being formed in the other end portion of the coil winding portion in the coil axis direction by the conductor being wound; a first insulating member including an annular first covering member covering the one end portion of the coil winding portion, a first tube portion extending from an inner edge of the first covering member to the coil winding portion side along the coil axis direction and inserted inside the coil winding portion, a first protruding portion provided on the coil winding portion side of the first covering member and fitted into the first slit, and a first locking portion provided in the first tube portion; and a second insulating member including an annular second covering member covering the other end portion of the coil winding portion, a second tube portion extending from an inner edge of the second covering member to the coil winding portion side along the coil axis direction and inserted inside the coil winding portion, a second protruding portion provided on the coil winding portion side of the second covering member and fitted into the second slit, and a second locking portion provided in the second tube portion and locked in the first locking portion in a state where the first protruding portion is fitted into the first slit and the second protruding portion is fitted into the second slit.

According to another aspect of the present invention, in the coil component, it is preferable that the coil winding portion includes: a first winding portion formed in an ended ring shape and having the first slit formed by one end portion and the other end portion in a circumferential direction about the coil axis; a second winding portion formed in an ended ring shape and having the second slit formed by one end portion and the other end portion in a circumferential direction about the coil axis; and a connecting portion interconnecting the one end portion of the first winding portion and the other end portion of the second winding portion along the coil axis direction in a positional relationship in which the first winding portion and the second winding portion are spaced apart from each other along the coil axis direction.

According to still another aspect of the present invention, in the coil component, it is preferable that the first insulating member and the second insulating member are provided such that: the first tube portion is inserted inside the second tube portion; one of the first tube portion and the second tube portion has a projecting portion; the other of the first tube portion and the second tube portion has a third slit formed along the coil axis direction; and the projecting portion is fitted into the third slit at a position where the first locking portion and the second locking portion are locked.

In order to achieve the object, a coil insulating member according to still another aspect of the present invention includes a first insulating member including an annular first covering member covering one end portion of a coil winding portion, a first tube portion extending from an inner edge of the first covering member to the coil winding portion side along a coil axis direction and inserted inside the coil winding portion, a first protruding portion provided on the coil winding portion side of the first covering member and fitted into a first slit, and a first locking portion provided in the first tube portion, the coil winding portion being formed by a single conductor being wound more than once around a coil axis, the first slit being formed in the one end portion of the coil winding portion in the coil axis direction along the coil axis, and a second slit being formed in the other end portion of the coil winding portion in the coil axis direction by the conductor being wound; and a second insulating member including an annular second covering member covering the other end portion of the coil winding portion, a second tube portion extending from an inner edge of the second covering member to the coil winding portion side along the coil axis direction and inserted inside the coil winding portion, a second protruding portion provided on the coil winding portion side of the second covering member and fitted into the second slit, and a second locking portion provided in the second tube portion and locked in the first locking portion in a state where the first protruding portion is fitted into the first slit and the second protruding portion is fitted into the second slit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A mode (embodiment) for carrying out the present invention will be described in detail with reference to accompanying drawings. The present invention is not limited by the content described in the following embodiment. In addition, the following constituent elements include those that can be easily assumed by those skilled in the art and those that are substantially identical. Further, the configurations described below can be appropriately combined. In addition, various omissions, substitutions, or changes in configuration can be made without departing from the gist of the present invention.

Embodiments

Figure 1:
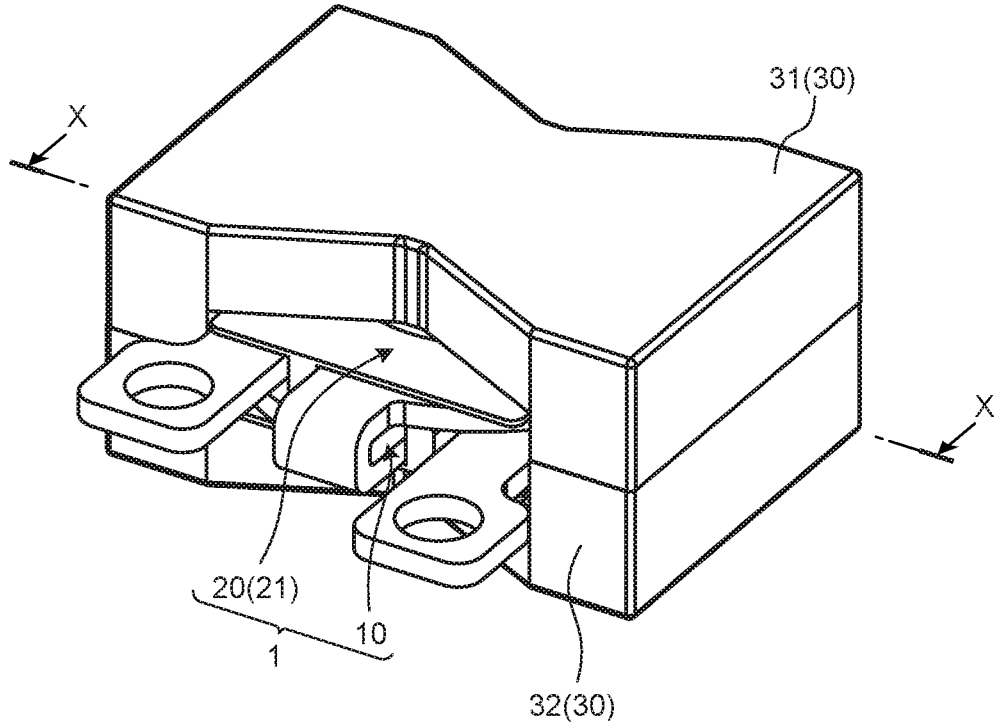
FIG. 1 is a perspective view illustrating a configuration example of a coil component according to an embodiment.

A coil component 1 and an insulating bobbin 20 according to the embodiment will be described below. The coil component 1 is, for example, a component used for a transformer of a switching power supply device or the like. As illustrated in FIG. 1, the coil component 1 is provided with a coil winding portion 10, the insulating bobbin 20 as a coil insulating member, and a pair of core members 30.

Figure 2:
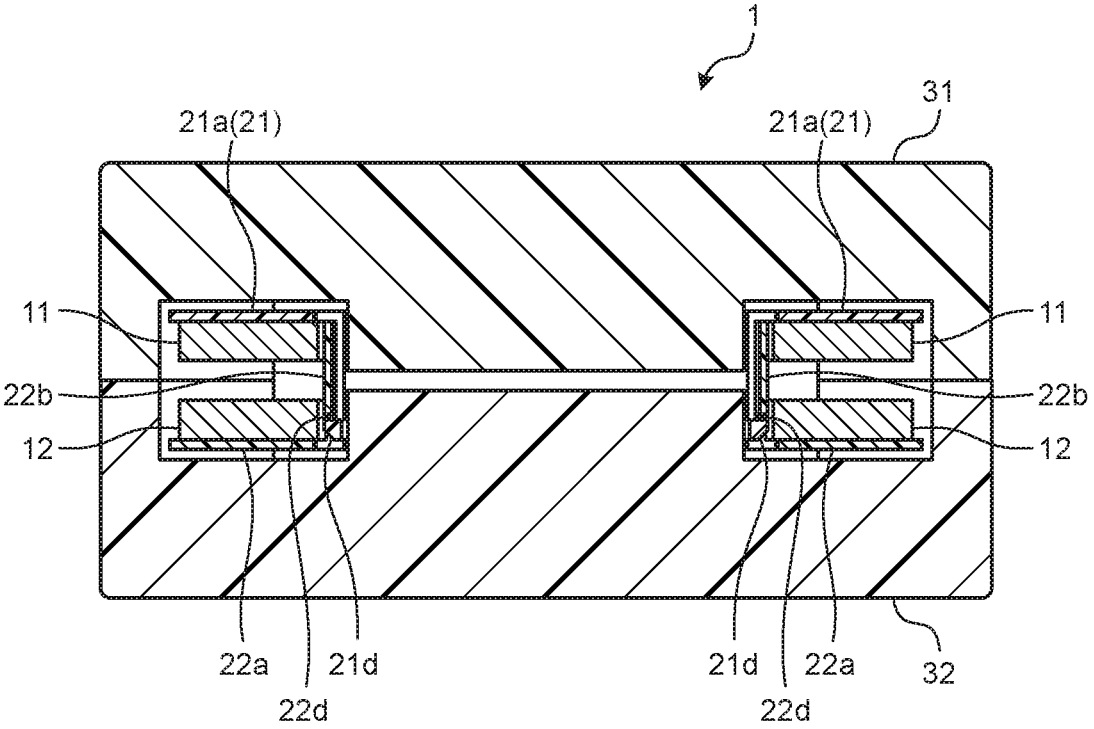
FIG. 2 is a cross-sectional view taken along line X-X of FIG. 1, which illustrates the configuration example of the coil component according to the embodiment.
Figure 3:
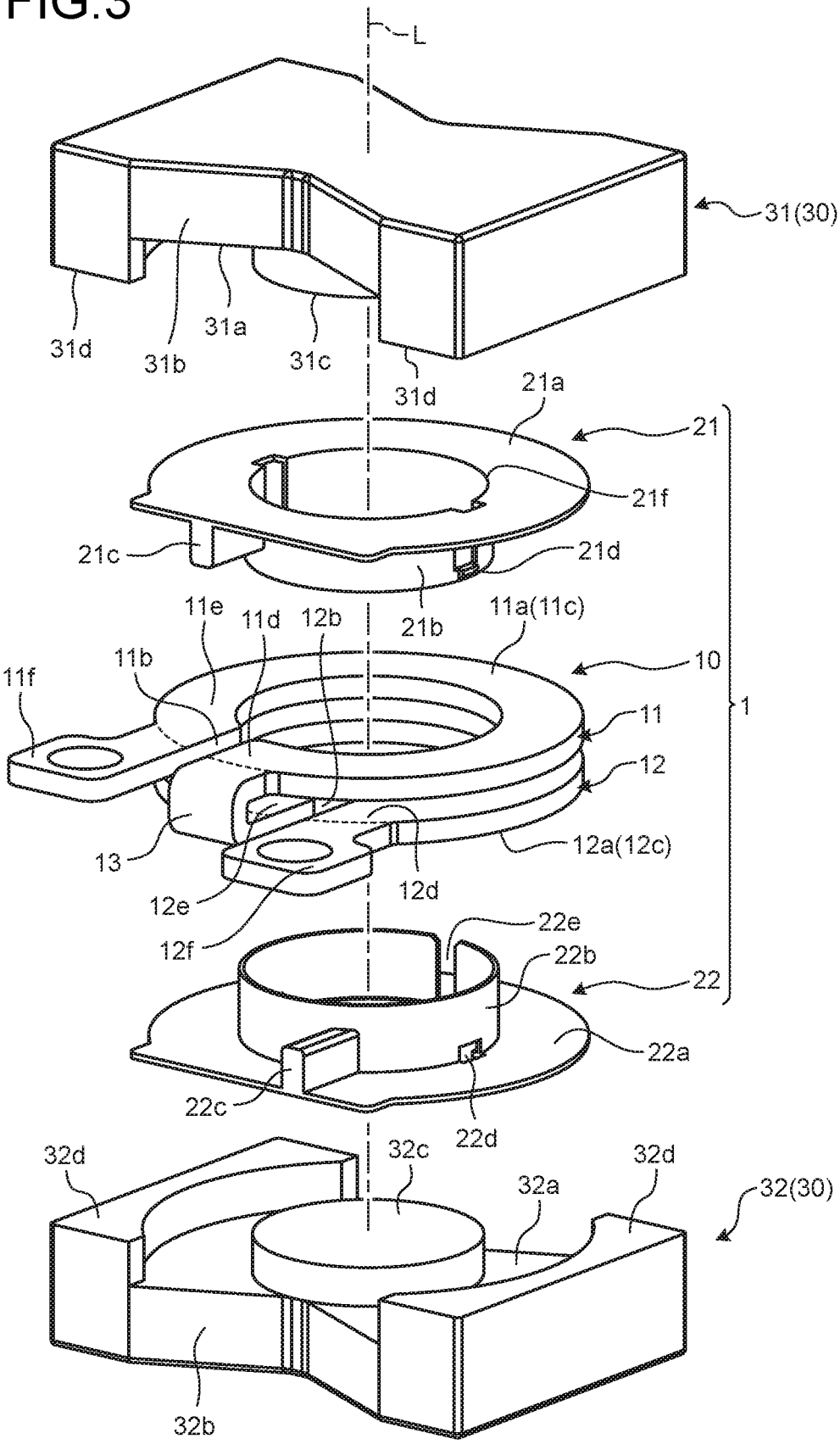
FIG. 3 is an exploded perspective view illustrating the configuration example of the coil component according to the embodiment.

The coil winding portion 10 is a coil formed by a single conductor being wound more than once around a coil axis L. As illustrated in FIGS. 2 and 3, in the present embodiment, the coil winding portion 10 is formed by a flat plate-shaped linear conductor being wound twice around the coil axis L. The coil winding portion 10 has a first winding portion 11, a second winding portion 12, and a connecting portion 13. In the coil winding portion 10, the first winding portion 11 and the second winding portion 12 are spaced apart from each other along the coil axis L direction and the first winding portion 11 and the second winding portion 12 are connected to each other by the connecting portion 13. Here, the coil axis L direction is a direction along the coil axis L. In the coil winding portion 10, a first slit 11*b* is formed in a first annular end surface 11*a* as an end portion on one side in the coil axis L direction and a second slit 12*b* is formed in a second annular end surface 12*a* as an end portion on the other side in the coil axis L direction by the conductor being wound.

The first winding portion 11 is formed in an ended ring shape. In other words, the first winding portion 11 is formed such that both tip portions of the conductor in the direction in which the conductor extends are spaced apart from each other by the conductor being annularly wound about the coil axis L direction and along a coil axis orthogonal direction, which is orthogonal to the coil axis L. When viewed from the coil axis L direction, the first winding portion 11 is formed in a C shape and is formed in a flat plate shape perpendicular to the coil axis L direction. The first winding portion 11 has a first axis portion main body 11*c*, a first terminal end portion 11*d* as an end portion on one side in a circumferential direction about the coil axis L, and a first starting end portion 11*e* as an end portion on the other side in the circumferential direction about the coil axis L. In the first axis portion main body 11*c*, the first slit 11*b* is formed by the first starting end portion 11*e* and the first terminal end portion 11*d* facing each other. The first slit 11*b* has a shape in which the first axis portion main body 11*c* is cut along the coil axis orthogonal direction. In the first winding portion 11, a first terminal portion 11*f* is provided in the first starting end portion 11*e*. In addition, in the first winding portion 11, the first terminal end portion 11*d* is connected to the second winding portion 12 by the connecting portion 13.

The second winding portion 12 is formed in an ended ring shape. In other words, the second winding portion 12 is formed such that both tip portions of the conductor in the direction in which the conductor extends face each other and are spaced apart from each other by the conductor being annularly wound about the coil axis L direction and along a coil axis orthogonal direction. When viewed from the coil axis L direction, the second winding portion 12 is formed in a C shape, is formed in a flat plate shape perpendicular to the coil axis L direction, and has the same size as the first winding portion 11. The second winding portion 12 has a second axis portion main body 12*c*, a second terminal end portion 12*d* as an end portion on one side in the circumferential direction about the coil axis L, and a second starting end portion 12*e* as an end portion on the other side in the circumferential direction about the coil axis L. In the second axis portion main body 12*c*, the second slit 12*b* is formed by the second starting end portion 12*e* and the second terminal end portion 12*d* facing each other. The second slit 12*b* has a shape in which the second axis portion main body 12*c* is cut along the coil axis orthogonal direction. In the second winding portion 12, the second starting end portion 12*e* is connected to the first terminal end portion 11*d* of the first winding portion 11 by the connecting portion 13. In addition, in the second winding portion 12, a second terminal portion 12*f* is provided in the second terminal end portion 12*d*.

In a state where the first winding portion 11 and the second winding portion 12 are spaced apart from each other along the coil axis L direction, the connecting portion 13 interconnects the first terminal end portion 11*d* of the first winding portion 11 and the second starting end portion 12*e* of the second winding portion 12 along the coil axis L direction. As a result, in the coil winding portion 10, electric currents in the same direction flow about the coil axis L from the first terminal portion 11*f* of the first winding portion 11 to the second terminal portion 12*f* of the second winding portion 12.

The insulating bobbin 20 is a coil insulating member insulating the coil winding portion 10 from the core members 30, other electronic components, and the like. The insulating bobbin 20 is formed of a resin excellent in heat resistance and rigidity and is formed of, for example, poly phenylene sulfide (PPS) resin. The insulating bobbin 20 is manufactured by resin injection molding and with a mold or the like. The insulating bobbin 20 is provided with a first insulating bobbin 21 as a first insulating member and a second insulating bobbin 22 as a second insulating member. The insulating bobbin 20 is assembled to the coil winding portion 10 by the first insulating bobbin 21 and the second insulating bobbin 22 pinching the coil winding portion 10 from both sides in the coil axis L direction.

Figure 4:
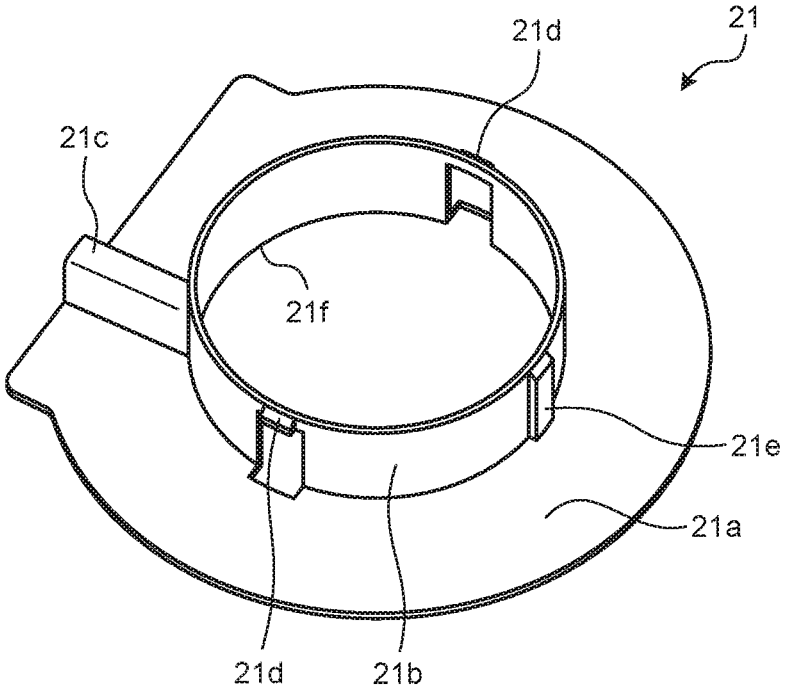
FIG. 4 is a perspective view illustrating a configuration example of a first insulating bobbin according to the embodiment.

As illustrated in FIG. 4, the first insulating bobbin 21 has a first flange portion 21*a* as a first covering member, a first tube portion 21*b*, a first rib 21*c* as a first protruding portion, a pair of locking claw portions 21*d* as first locking portions, and a projecting portion 21*e*.

The first flange portion 21*a* is a member that covers the first annular end surface 11*a*, which is one end portion of the coil winding portion 10 in the coil axis L direction. The first flange portion 21*a* is formed in an annular and flat plate shape. For example, the first flange portion 21*a* extends along the coil axis orthogonal direction from one edge portion of the first tube portion 21*b* toward the outside of the first tube portion 21*b*. When viewed from the coil axis L direction, the first flange portion 21*a* overlaps with the first annular end surface 11*a* of the coil winding portion 10. The first flange portion 21*a* is formed such that the outer periphery of the first flange portion 21*a* is slightly larger than the outer periphery of the first annular end surface 11*a*.

The first tube portion 21*b* is a tubular member extending from an inner edge 21*f* of the first flange portion 21*a* to the coil winding portion 10 side along the coil axis L direction. The length of the first tube portion 21*b* in the coil axis L direction is approximately the same as the thickness of the coil winding portion 10 in the coil axis L direction. The first tube portion 21*b* is inserted inside the coil winding portion 10. Further, the first tube portion 21*b* is inserted inside a second tube portion 22*b* of the second insulating bobbin 22, which will be described later.

The first rib 21*c* is a protruding portion provided on the coil winding portion 10 side of the first flange portion 21*a*, that is, the first tube portion 21*b* side of the first flange portion 21*a*. The first rib 21*c* determines the relative positions of the first insulating bobbin 21 and the coil winding portion 10 in the circumferential direction of the coil axis L and is provided at a position that determines the relative positions. The first rib 21*c* protrudes along the coil axis L direction and is fitted into the first slit 11*b*.

The pair of locking claw portions 21*d* is locking portions locked in a pair of locking opening portions 22*d* of the second insulating bobbin 22, which will be described later. The pair of locking claw portions 21*d* is provided in the first tube portion 21*b* and is provided at positions corresponding to the pair of locking opening portions 22*d* of the second insulating bobbin 22. For example, the pair of locking claw portions 21*d* is provided at positions facing each other in the coil axis orthogonal direction on the outer peripheral surface of the first tube portion 21*b*. The pair of locking claw portions 21*d* is positioned in the end portion of the first tube portion 21*b* that is on the side opposite to the first flange portion 21*a* and protrudes in the coil axis orthogonal direction. The first tube portion 21*b* above the pair of locking claw portions 21*d* (on the first flange portion 21*a* side) is partially hollowed out so that the pair of locking claw portions 21*d* is easily bent to the inside of the first tube portion 21*b* in a case where the pair of locking claw portions 21*d* is locked in the pair of locking opening portions 22*d*.

The projecting portion 21*e* is to more accurately determine the relative positions of the first insulating bobbin 21 and the second insulating bobbin 22 and is provided at a position that determines the relative positions. For example, the projecting portion 21*e* is provided at a position that determines the position where the pair of locking claw portions 21*d* and the pair of locking opening portions 22*d* are locked. For example, the projecting portion 21*e* is provided on the outer peripheral surface of the first tube portion 21*b*, protrudes in the coil axis orthogonal direction, and is linearly formed from one end to the other end of the first tube portion 21*b* along the coil axis L direction. The projecting portion 21*e* is fitted into a third slit 22*e* of the second insulating bobbin 22, which will be described later.

Figure 5:
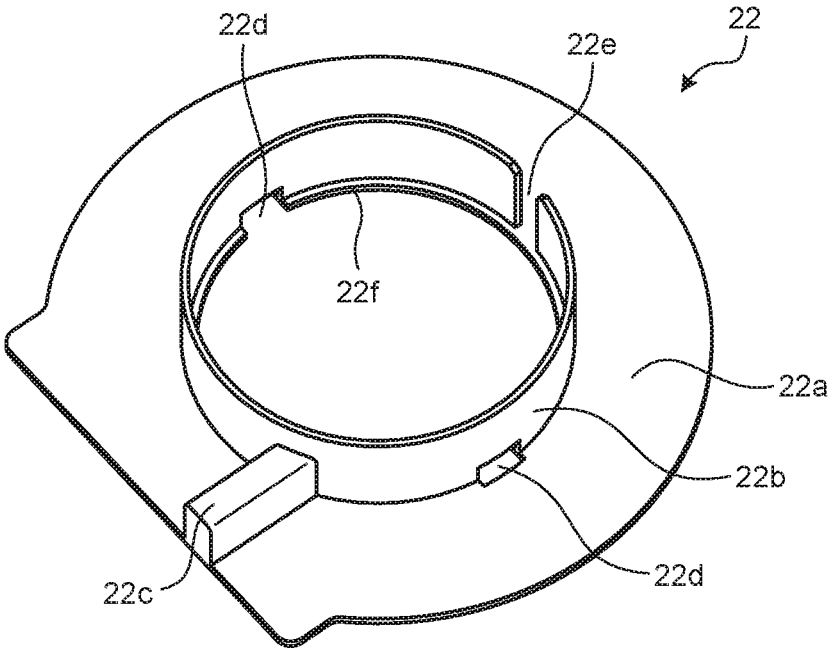
FIG. 5 is a perspective view illustrating a configuration example of a second insulating bobbin according to the embodiment.

As illustrated in FIG. 5, the second insulating bobbin 22 has a second flange portion 22*a* as a second covering member, the second tube portion 22*b*, a second rib 22*c* as a second protruding portion, the pair of locking opening portions 22*d* as second locking portions, and the third slit 22*e*.

The second flange portion 22*a* is a member that covers the second annular end surface 12*a*, which is the other end portion of the coil winding portion 10 in the coil axis L direction. The second flange portion 22*a* is formed in an annular and flat plate shape. For example, the second flange portion 22*a* extends along the coil axis orthogonal direction from one edge portion of the second tube portion 22*b* toward the outside of the second tube portion 22*b*. When viewed from the coil axis L direction, the second flange portion 22*a* overlaps with the second annular end surface 12*a* of the coil winding portion 10. The second flange portion 22*a* is formed such that the outer periphery of the second flange portion 22*a* is slightly larger than the outer periphery of the second annular end surface 12*a*.

The second tube portion 22*b* is a tubular member extending from an inner edge 22*f* of the second flange portion 22*a* to the coil winding portion 10 side along the coil axis L direction. The length of the second tube portion 22*b* in the coil axis L direction is approximately the same as the thickness of the coil winding portion 10 in the coil axis L direction. The second tube portion 22*b* is inserted inside the coil winding portion 10.

The second rib 22*c* is a protruding portion provided on the coil winding portion 10 side of the second flange portion 22*a*, that is, the second tube portion 22*b* side of the second flange portion 22*a*. The second rib 22*c* determines the relative positions of the second insulating bobbin 22 and the coil winding portion 10 in the circumferential direction of the coil axis L and is provided at a position that determines the relative positions. The second rib 22*c* protrudes along the coil axis L direction and is fitted into the second slit 12*b*.

The pair of locking opening portions 22*d* is locking portions locked with the locking claw portions 21*d* of the first insulating bobbin 21. The pair of locking opening portions 22*d* is provided in the second tube portion 22*b* and is provided at positions corresponding to the pair of locking claw portions 21*d* of the first insulating bobbin 21. For example, the pair of locking opening portions 22*d* is provided at positions facing each other in the coil axis orthogonal direction in the outer peripheral surface of the second tube portion 22*b*. The pair of locking opening portions 22*d* is positioned in the end portion of the second tube portion 22*b* that is on the second flange portion 22*a* side and is open in the coil axis orthogonal direction. The locking claw portions 21*d* are locked in the pair of locking opening portions 22*d* in a state where the first rib 21*c* is fitted into the first slit 11*b* and the second rib 22*c* is fitted into the second slit 12*b*.

The third slit 22*e* is to more accurately determine the relative positions of the first insulating bobbin 21 and the second insulating bobbin 22 in cooperation with the projecting portion 21*e* of the first insulating bobbin 21 and is provided at a position that determines the relative positions. For example, the third slit 22*e* is provided at a position that determines the position where the pair of locking claw portions 21*d* and the pair of locking opening portions 22*d* are locked in cooperation with the projecting portion 21*e* of the first insulating bobbin 21. For example, the third slit 22*e* is a cut portion provided in the main body (inner peripheral surface) of the second tube portion 22*b* and is linearly formed from one end to the other end of the second tube portion 22*b* along the coil axis L direction. The third slit 22*e* is fitted along the coil axis L direction into the projecting portion 21*e* of the first insulating bobbin 21 at the position where the pair of locking claw portions 21*d* and the pair of locking opening portions 22*d* are locked.

The pair of core members 30 is formed so as to include, for example, ferrite as a magnetic body with high magnetic permeability. A first core member 31 has a first base portion 31*b* having a main surface 31*a*, a first circular column portion 31*c* protruding in the coil axis L direction in the middle of the main surface 31*a*, and a pair of first pinching columns 31*d* provided across the first circular column portion 31*c* at both ends of the main surface 31*a* and protruding in the coil axis L direction. The first circular column portion 31*c* is formed such that the diameter of the first circular column portion 31*c* is shorter than the diameter of the first tube portion 21*b* and is inserted inside the first tube portion 21*b* in a state where the coil component 1 is placed on the main surface 31*a* of the first base portion 31*b*. The pair of first pinching columns 31*d* pinches the first insulating bobbin 21 side of the coil component 1 from the coil axis orthogonal direction in a state where the coil component 1 is placed on the main surface 31*a* of the first base portion 31*b*.

A second core member 32 has the same shape as the first core member 31 and has a second base portion 32*b* having a main surface 32*a*, a second circular column portion 32*c* protruding in the coil axis L direction in the middle of the main surface 32*a*, and a pair of second pinching columns 32*d* provided across the second circular column portion 32*c* at both ends of the main surface 32*a* and protruding in the coil axis L direction. The second circular column portion 32*c* is formed such that the diameter of the second circular column portion 32*c* is shorter than the diameter of the second tube portion 22*b* and is inserted inside the second tube portion 22*b* in a state where the coil component 1 is placed on the main surface 32*a* of the second base portion 32*b*. The pair of second pinching columns 32*d* pinches the coil component 1 from the coil axis orthogonal direction in a state where the coil component 1 is placed on the main surface 32*a* of the second base portion 32*b*. In a state where the pair of core members 31 and 32 is assembled to the coil component 1, the end surfaces of the pair of first pinching columns 31*d* in the coil axis L direction abut against the end surfaces of the pair of second pinching columns 32*d* in the coil axis L direction.

Next, a method for assembling the coil component 1 and the core member 30 will be described. The second tube portion 22*b* of the second insulating bobbin 22 is inserted inside the coil winding portion 10 from one side in the coil axis L direction and the second rib 22*c* of the second insulating bobbin 22 is fitted into the second slit 12*b* of the coil winding portion 10. Next, the first tube portion 21*b* of the first insulating bobbin 21 is inserted inside the coil winding portion 10 from the other side in the coil axis L direction. At this time, the projecting portion 21*e* of the first insulating bobbin 21 is fitted into the third slit 22*e* of the second insulating bobbin 22 inserted inside the coil winding portion 10. As a result, the relative positions of the first insulating bobbin 21 and the second insulating bobbin 22 are determined, and the pair of locking claw portions 21*d* and the pair of locking opening portions 22*d* can be aligned with ease. The pair of locking claw portions 21*d* is locked in the pair of locking opening portions 22*d* in a state where the first rib 21*c* of the first insulating bobbin 21 is fitted into the first slit 11*b* of the coil winding portion 10. As a result, the coil component 1 is assembled to the coil winding portion 10 in a state where the first and second insulating bobbins 21 and 22 are locked and the first and second ribs 21*c* and 22*c* suppress rotation of the first and second insulating bobbins 21 and 22 around the coil axis L with respect to the coil winding portion 10.

Next, the second circular column portion 32*c* of the second core member 32 is inserted inside the first and second tube portions 21*b* and 22*b* from one side in the coil axis L direction and the outer periphery of the second flange portion 22*a* of the second insulating bobbin 22 is partially pinched by the pair of second pinching columns 32*d*. Likewise, the first circular column portion 31*c* of the first core member 31 is inserted inside the first and second tube portions 21*b* and 22*b* from the other side in the coil axis L direction and the outer periphery of the first flange portion 21*a* of the first insulating bobbin 21 is partially pinched by the pair of first pinching columns 31*d*. At this time, the end surfaces of the pair of first pinching columns 31*d* in the coil axis L direction abut against the end surfaces of the pair of second pinching columns 32*d* in the coil axis L direction.

As described above, the coil component 1 and the insulating bobbin 20 according to the embodiment are provided with the first insulating bobbin 21 having the first flange portion 21*a*, the first rib 21*c*, and the pair of locking claw portions 21*d* and the second insulating bobbin 22 having the second flange portion 22*a*, the second rib 22*c*, and the pair of locking opening portions 22*d*. The pair of locking claw portions 21*d* and the pair of locking opening portions 22*d* are locked in a state where both end portions of the coil winding portion 10 in the coil axis L direction are covered with the first and second flange portions 21*a* and 22*a* and the first and second ribs 21*c* and 22*c* are respectively fitted into the first and second slits 11*b* and 12*b* of the coil winding portion 10. As a result, with the coil component 1 and the insulating bobbin 20, both end portions of the coil winding portion 10 in the coil axis L direction can be insulated from the core members 30, other electronic components, and the like by the first and second flange portions 21*a* and 22*a*. In addition, in the coil component 1 and the insulating bobbin 20, the first and second insulating bobbins 21 and 22 are assembled to the coil winding portion 10 in a state where the first rib 21*c* is fitted into the first slit 11*b* inevitably formed in the coil winding portion 10 and the second rib 22*c* is fitted into the second slit 12*b* inevitably formed in the coil winding portion 10, and thus it is possible to suppress rotation of the first and second insulating bobbins 21 and 22 around the coil axis L with respect to the coil winding portion 10 without processing of the coil winding portion 10 attributable to the first and second insulating bobbins 21 and 22. In addition, the first and second ribs 21*c* and 22*c* are respectively fitted into the first and second slits 11*b* and 12*b* in the coil component 1 and the insulating bobbin 20, and thus the relative positions of the first insulating bobbin 21 and the second insulating bobbin 22 around the coil axis L can be aligned and the first insulating bobbin 21 and the second insulating bobbin 22 can be easily locked by the pair of locking claw portions 21*d* and the pair of locking opening portions 22*d*. In this manner, the coil component 1 and the insulating bobbin 20 allow workability to be improved when the insulating bobbin 20 is assembled to the coil winding portion 10 while ensuring adequate insulation performance. In addition, the coil component 1 and the insulating bobbin 20 allow the configurations of the first and second insulating bobbins 21 and 22 to be simplified as two components constitute the insulating bobbin 20, one being the first insulating bobbin 21 and the other being the second insulating bobbin 22. As a result, the coil component 1 and the insulating bobbin 20 can be manufactured with ease, and thus cost reduction can be achieved.

In the coil component 1, the coil winding portion 10 is provided with the ended ring-shaped first winding portion 11 having the first slit lib formed by the first terminal end portion 11*d* as one end portion in the circumferential direction about the coil axis L and the first starting end portion 11*e* as the other end portion in the circumferential direction about the coil axis L, the ended ring-shaped second winding portion 12 having the second slit 12*b* formed by the second terminal end portion 12*d* as one end portion in the circumferential direction about the coil axis L and the second starting end portion 12*e* as the other end portion in the circumferential direction about the coil axis L, and the connecting portion 13 interconnecting the first terminal end portion 11*d* of the first winding portion 11 and the second starting end portion 12*e* of the second winding portion 12 along the coil axis L direction in a positional relationship in which the first winding portion 11 and the second winding portion 12 are spaced apart from each other along the coil axis L direction. As a result, with the coil winding portion 10, it is possible to determine the relative positions of the first and second insulating bobbins 21 and 22 with respect to the coil winding portion 10 without processing of the coil winding portion 10 attributable to the first and second insulating bobbins 21 and 22.

In the first insulating bobbin 21 and the second insulating bobbin 22 of the coil component 1, the first tube portion 21*b* is inserted inside the second tube portion 22*b*, the first tube portion 21*b* has the projecting portion 21*e*, the second tube portion 22*b* has the third slit 22*e* formed along the coil axis L direction, and the projecting portion 21*e* is fitted into the third slit 22*e* at the position where the pair of locking claw portions 21*d* and the pair of locking opening portions 22*d* are locked. As a result, in the coil component 1, the relative positions of the first insulating bobbin 21 and the second insulating bobbin 22 are determined and the pair of locking claw portions 21*d* and the pair of locking opening portions 22*d* can be aligned with ease.

Modification Example

A modification example of the embodiment will be described below. The first and second insulating bobbins 21 and 22 may have the third slit 22*e* in the first tube portion 21*b* and may have the projecting portion 21*e* in the second tube portion 22*b*. As for the first and second insulating bobbins 21 and 22 in this case, the projecting portion 21*e* is fitted into the third slit 22*e* at the position where the pair of locking claw portions 21*d* and the pair of locking opening portions 22*d* are locked.

The first slit 11*b* may be configured to include the first terminal portion 11*f* and the connecting portion 13. The second slit 12*b* may be configured to include the second terminal portion 12*f* and the connecting portion 13.

The present invention is not limited to the above-described example in which the first tube portion 21*b* is inserted and locked inside the second tube portion 22*b*. For example, the first tube portion 21*b* and the second tube portion 22*b* may have tip portions abutting against each other in the coil axis L direction and a lock mechanism may be provided so that the first tube portion 21*b* and the second tube portion 22*b* are locked with the tip portions abutting against each other.

A coil component and a coil insulating member according to the present embodiment are provided with a first insulating member having a first covering member, a first protruding portion, and a first locking portion and a second insulating member having a second covering member, a second protruding portion, and a second locking portion. The first locking portion and the second locking portion are locked in a state where both end portions of a coil winding portion in a coil axis direction are covered with the first and second covering members and the first and second protruding portions are respectively fitted into first and second slits of the coil winding portion. As a result, the coil component and the coil insulating member allow workability to be improved when the coil insulating member is assembled to the coil winding portion while ensuring adequate insulation performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coil component comprising:

a coil winding portion formed by a single conductor being wound more than once around a coil axis, a first slit being formed in one end portion of the coil winding portion in a coil axis direction along the coil axis and a second slit being formed in the other end portion of the coil winding portion in the coil axis direction by the conductor being wound;

a first insulating member including an annular first covering member covering the one end portion of the coil winding portion, a first tube portion extending from an inner edge of the first covering member to the coil winding portion side along the coil axis direction and inserted inside the coil winding portion, a first protruding portion provided on the coil winding portion side of the first covering member and fitted into the first slit, and a first locking portion provided in the first tube portion; and a second insulating member including an annular second covering member covering the other end portion of the coil winding portion, a second tube portion extending from an inner edge of the second covering member to the coil winding portion side along the coil axis direction and inserted inside the coil winding portion, a second protruding portion provided on the coil winding portion side of the second covering member and fitted into the second slit, and a second locking portion provided in the second tube portion and locked in the first locking portion in a state where the first protruding portion is fitted into the first slit and the second protruding portion is fitted into the second slit.

2. The coil component according to claim 1, wherein the coil winding portion includes:

a first winding portion formed in an ended ring shape and having the first slit formed by one end portion and the other end portion in a circumferential direction about the coil axis;

a second winding portion formed in an ended ring shape and having the second slit formed by one end portion and the other end portion in a circumferential direction about the coil axis; and a connecting portion interconnecting the one end portion of the first winding portion and the other end portion of the second winding portion along the coil axis direction in a positional relationship in which the first winding portion and the second winding portion are spaced apart from each other along the coil axis direction.

3. The coil component according to claim 1, wherein the first insulating member and the second insulating member are provided such that:

the first tube portion is inserted inside the second tube portion;

one of the first tube portion and the second tube portion has a projecting portion;

the other of the first tube portion and the second tube portion has a third slit formed along the coil axis direction; and the projecting portion is fitted into the third slit at a position where the first locking portion and the second locking portion are locked.

4. The coil component according to claim 2, wherein the first insulating member and the second insulating member are provided such that:

the first tube portion is inserted inside the second tube portion;

one of the first tube portion and the second tube portion has a projecting portion;

the other of the first tube portion and the second tube portion has a third slit formed along the coil axis direction; and the projecting portion is fitted into the third slit at a position where the first locking portion and the second locking portion are locked.

5. A coil insulating member comprising:

a first insulating member including an annular first covering member covering one end portion of a coil winding portion, a first tube portion extending from an inner edge of the first covering member to the coil winding portion side along a coil axis direction and inserted inside the coil winding portion, a first protruding portion provided on the coil winding portion side of the first covering member and fitted into a first slit, and a first locking portion provided in the first tube portion, the coil winding portion being formed by a single conductor being wound more than once around a coil axis, the first slit being formed in the one end portion of the coil winding portion in the coil axis direction along the coil axis, and a second slit being formed in the other end portion of the coil winding portion in the coil axis direction by the conductor being wound; and a second insulating member including an annular second covering member covering the other end portion of the coil winding portion, a second tube portion extending from an inner edge of the second covering member to the coil winding portion side along the coil axis direction and inserted inside the coil winding portion, a second protruding portion provided on the coil winding portion side of the second covering member and fitted into the second slit, and a second locking portion provided in the second tube portion and locked in the first locking portion in a state where the first protruding portion is fitted into the first slit an the second protruding portion is fitted into the second slit.

* * * * *